United States Patent [19]

Howard et al.

[11] Patent Number: 4,469,266

[45] Date of Patent: Sep. 4, 1984

[54] FEED AND LOCK MECHANISM FOR MULTIPLE BAR DRAPED WEB COLLATOR AND METHOD

[75] Inventors: John B. Howard; Dean E. Gladow, both of Emporia, Kans.

[73] Assignee: Didde Graphic Systems Corporation, Emporia, Kans.

[21] Appl. No.: 376,545

[22] Filed: May 10, 1982

[51] Int. Cl.[3] ..... B65H 17/42

[52] U.S. Cl. ..... 226/106

[58] Field of Search ..... 226/104, 105, 106, 107; 68/5 D, 5 C

[56] References Cited

U.S. PATENT DOCUMENTS

| | | | |
|---|---|---|---|
| 257,703 | 5/1882 | Hilbers | 226/104 |
| 2,196,921 | 4/1940 | Hurxthal | 226/105 |
| 2,534,026 | 12/1950 | Hurxthal | 226/106 X |
| 2,620,183 | 12/1952 | Kyle et al. | 226/106 X |
| 2,951,698 | 9/1960 | Parkes | 226/107 X |
| 4,207,998 | 6/1980 | Schmid | 226/95 |
| 4,307,830 | 12/1981 | Didde | 226/104 |

*Primary Examiner*—Stuart S. Levy
*Assistant Examiner*—Joseph J. Hail, III
*Attorney, Agent, or Firm*—Schmidt, Johnson, Hovey & Williams

[57] ABSTRACT

An improved continuous web handling apparatus and method for printing, handling, collating and final processing of multiple-page printed items such as business forms or the like is provided which employs separate, shiftable, track-mounted web supports having individual, pivotal, spring-biased web keepers to facilitate accurate, continuous draping of printed webs onto the supports for subsequent handling and processing thereof. In preferred forms, the apparatus includes a web fed printing press which continuously feeds printed web to a draping station adjacent the conveyor track; the draping station includes a novel, vacuum air pickup bar intermittently rotated by a five-lobe internal geneva gear mechanism, along with actuating apparatus which pivots the respective web keepers open during initial stages of web drapage and thereafter allows the keepers to close against and hold the web in place. A plurality of webs can be draped one on top of the other on the supports and/or printed on both sides thereof and thereafter removed from the supports for additional processing at speeds economical for short run printing, without fear that the webs will become unacceptably misaligned. The air pickup bar includes an improved web-engaging resilient suction pad, and internal structure for varying the number of bar ports subjected to vacuum or pressure conditions (in order to effectively handle webs of various widths). The web supports are bidirectionally shiftable, and the keepers can be operated during travel in either direction.

36 Claims, 26 Drawing Figures

12.
12.

FEED AND LOCK MECHANISM FOR MULTIPLE BAR DRAPED WEB COLLATOR AND METHOD

BACKGROUND OF THE INVENTION

1. Field of the Invention

The present invention is concerned with an apparatus and method for continuous handling and processing of one or more elongated, printed webs in order to eliminate sequential processing, rewind, storage, unwinding and subsequent processing of individual webs as has heretofore been the practice in production of multiple-page printed items. More particularly, it is concerned with an improved apparatus and method of the type described in U.S. Pat. No. 4,307,830 entitled "Web Fed Printing Collator Processing Unit and Method." This patent is hereby incorporated by reference herein.

2. Description of the Prior Art

The production of multiple-page printed items such as business forms, booklets or small catalogs has traditionally been accomplished by performing a number of essentially discrete steps. That is to say, it is the common practice to separately print elongated webs which are temporarily wound and stored in large rolls. Other common practices include production of sheets, signatures, or zig-zag folded webs. These are also temporarily stored in the form of individual stacks. After all of the material has been printed, the rolls or stacks of paper are moved to a bindery site which conventionally includes final processing equipment such as a web fed roll collator, gatherer, bindery or other known equipment. During the final processing operations, the individual webs, sheets, signatures, etc. are collated, placed in registration and the complete set subjected to final processing. The latter may involve, e.g., cross-perforation and Z-folding, gluing and cutting, staple bindery, and/or further folding and trimming.

A persistent problem in connection with these operations stems from the fact that they are relatively labor intensive, i.e., the non-continuous nature of the process inherently creates a situation where a number of workers must be employed for handling and to carry out the many startup operations. Therefore, the time and expense required for production of multiple-page printed items is correspondingly significant.

The above factors are of particular importance in connection with so-called "short runs." In such cases labor costs represent a large proportion of the total expense in producing the finished product. In fact, in many cases the cost of producing a small number of the finished product is very close to the cost for producing a much larger number. Further, short runs often represent a significant part of a printer's business, and therefore any means of reducing costs in this area represents a real advancement in the art.

Another problem inherent in current equipment is the recognition and handling of waste product. Because the material is typically being handled in the form of tightly wound rolls or tightly packed piles of sheeted or folded material, it is difficult to recognize material which is damaged or incomplete. In many cases, this waste product is not found until final processing is being completed; in other cases, the final product is shipped with waste material included. An important related problem is that often the extent of waste material within a roll or pile is unknown. It is therefore difficult to "make things come out even." For example, when all of the acceptable material from shortest "good" roll has been used, there may remain a substantial amount on the other rolls which is then typically dumped into waste bins. The same is true with respect to runs involving collation or gathering of sheets or signatures from storage stacks. During printing from roll to roll, the pressman will insert a "flag" to indicate bad material. Each printed roll may have several flags. Thus, during collation, it is necessary to stop the collator at each flag and discard the waste product. Thus it is common practice for the press operator to print an excess length of web after an error has occurred to compensate for the unknown length of unsuitable material. The result is considerable wastage.

When printing from roll to sheet or sheet to sheet, unless the operator perceives that bad material is being printed and makes an accurate determination of how much he removes, before again directing the sheet to the accumulated stack, waste can again occur from overprinting to make up for an unknown loss, or the erroneously printed material may simply be buried in the storage stacks and present an unknown problem to the bindery operation which is not discovered until encountered during gathering or collating. Thus the problem is not only a factor of unknown wastage in printing, but inability to observe the printed material in stacked form until it is actually directed into the bindery machines.

Another problem present in currently used equipment concerns the drying of inks. All normally used inks require a certain amount of time to reach a dry condition when they will not smear or smudge; this time typically varies from a few seconds to several hours. Some of the current methods used to deal with this problem involve high energy dryers which attempt to speed up the drying process, typically to fractions of a second. Other methods include physical separation of the product, using such things as granular dusting powder. With materials stored in piles, intermediate supports or bars often have to be inserted into the pile to prevent excessive weight being transferred to the lower sheets where "offsetting" would occur.

Still another problem in current equipment is that most machines are essentially single purpose. For example, the several pieces of equipment necessary to produce business forms cannot be used to make booklets, or small newspapers or magazines. The expenditures necessary to obtain equipment to produce several types of products is quite prohibitive, particularly for short run production.

A recent, significant breakthrough in the art designed to overcome the problems noted above is described in the above referenced U.S. Pat. No. 4,307,830. This patent discloses an apparatus and method wherein a plurality of spaced web-supporting elements such as individual, trackmounted, shiftable bars are employed with web feeding and alignment means for feeding webs onto the elements in a draped relationship for support thereby. In this manner storage-in-process of the printed webs is provided, with the consequent elimination of many of the labor intensive steps associated with production of multiple-page printed items.

SUMMARY OF THE INVENTION

As noted, the present invention is designed to provide improved web handling apparatus and methods of the type described in U.S. Pat. No. 4,307,830. Specifically, the invention gives the ability to precisely deposit onto a moving support a particular point on a fast moving web (e.g., up to 500 feet/minute). In this way the webs can be accurately draped over web supports to ensure proper downstream processing.

Broadly speaking, the apparatus of the present invention includes a web handling conveyor system of the type including an elongated track, with a plurality of novel web supports mounted on the track and shiftable therealong, in conjunction with an improved web handling and draping station which receives continuously fed printed webs from a printing press or the like and successively drapes sections of the web over respective web supports shifted therepast. The overall apparatus also includes a web takeoff assembly (essentially identical with the web feeding and draping stations) for removing the draped web(s) from the supports and feeding the same for downstream processing.

The preferred web support includes an elongated bar-like web-supporting element and, associated with each element, a web keeper which is mounted for movement between a web-engaging position proximal to the element and an open position spaced therefrom. The keeper is preferably biased toward the web-engaging position thereof, typically by means of a torsion spring or the like.

The web supports are advantageously mounted on the track in a cantilever fashion, and for this purpose include a hanger member secured to one end thereof which allows the support to be removably suspended from the track.

The handling and draping station preferably includes means for draping a section of web over each respective web-supporting element, along with means for shifting the keeper of each respective element away from the associated element during draping of the web section thereover, and for shifting of the keeper into engagement with the web section after at least a portion of the draping thereof is completed, in order to hold the draped web section in place and assure proper registration with additional webs. The draping means preferably comprises a novel air pickup bar, means such as an internal geneva mechanism for intermittently shifting the bar into engagement with the moving web and thence into overlying relationship with the adjacent web-supporting element. During such movement of the air pickup bar, a vacuum is established within the bar in order to affix the web thereto, such vacuum being maintained until the bar is above the adjacent web-supporting element, whereupon the vacuum is relieved and the web is draped as aforesaid. The improved air pickup bar includes a web-contacting face in the form of an apertured, resilient pad. Additionally, the bar has an internal, elongated, axially rotatable tube having respective sets of apertures therethrough; the tube can be shifted so as to align corresponding apertures with air bar ports, so that the effective operational length of the bar can be varied to accommodate webs of different widths.

The apparatus and method hereof permit handling and storage-in-process of one or more webs, and in the latter case the webs are advantageously stored one atop the other in a generally conforming, draped relationship. The configuration of the track and web support structure also permits the web support to be shifted and operated in either of two directions at the discretion of the pressman, which gives additional operational flexibility.

BRIEF DESCRIPTION OF THE DRAWINGS

FIG. 1 is a fragmentary perspective view illustrating a complete system in accordance with the invention for printing, storage-in-process and final processing of webs for the production of business forms or the like;

DESCRIPTION OF THE PREFERRED EMBODIMENT

Figure 1:
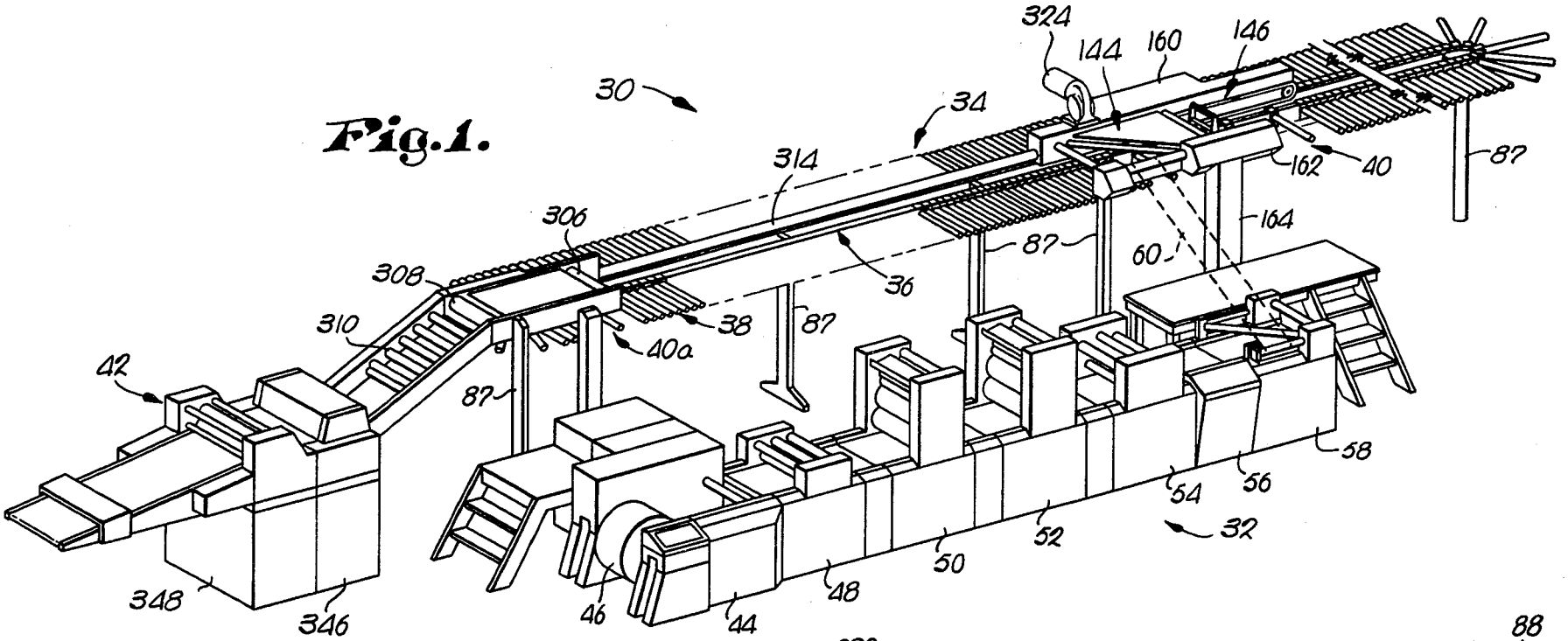

Turning now to the drawings, and particularly FIG. 1, a printing and collating processing unit 30 is illustrated and broadly includes a web-fed, in-line, multiple station printing press 32, a conveyor system broadly referred to by the numeral 34 and having a track 36 supporting a plurality of identical web supports 38, a web handling and draping station 40, a web takeoff assembly 40*a*, and an end processor 42.

Figure 21:
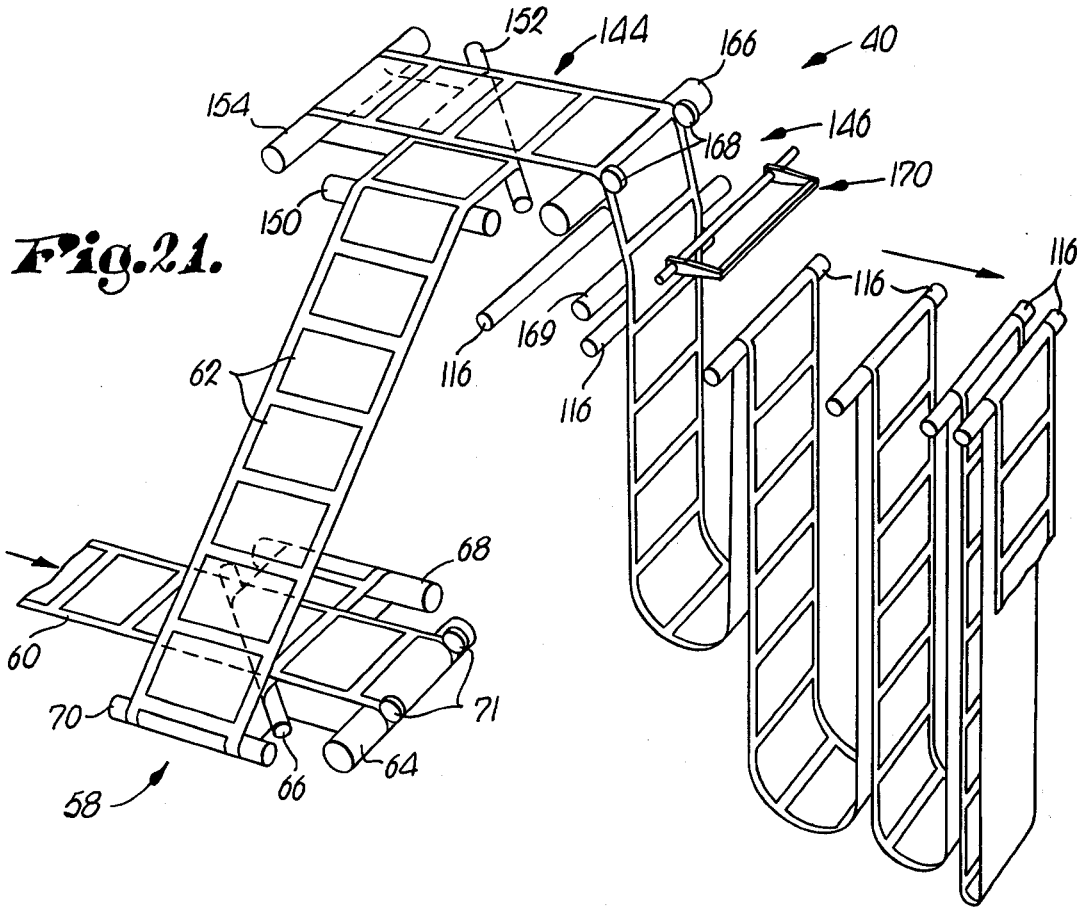
FIG. 21 is a fragmentary schematic view perspectively illustrating the turnbar assemblies operatively associated with the press and conveyor apparatus of the invention.

In more detail, the press 32 includes a roll stand 44 supporting a continuous roll of paper stock 46, a tensioning unit 48, a pair of printing towers 50, 52, a punch unit 54, a control console 56, and an output turnbar unit 58. The purpose of press 32 is to continuously imprint a web 60 derived from roll 46 with successive images 62 (FIG. 21), and to output the printed web via turnbar unit 58 to the conveyor system 34, and particularly to the web handling and draping station 40 thereof, in a manner such that the printed images 62 do not contact any surface. To this end (see FIG. 21), the unit 58 includes a series of web-engaging turning bars 64, 66, 68, 70, and a pair of web edge-contacting driven wheels 71 adjacent bar 64; the bar 64 is in spanning relationship to the web, whereas bar 66 is obliquely oriented and bars 68 and 70 are astride the path of travel of the incoming web. The web 60 is trained about the bars 66–70 as illustrated in FIG. 21 so that only the underside of the web engages the bars with the result that the web is turned and oriented for delivery to the station 40 with the images 62 being free of contact with any bar or surface. Further, although the press 32 has been illustrated with representative modules such as the printing towers 50, 52, and punch unit 54, those skilled in the art will recognize that other modules such as additional printing towers, numbering units or perforaters can be employed as part of the overall press 32, depending upon the desired specifications for the printed web 60.

Figure 2:
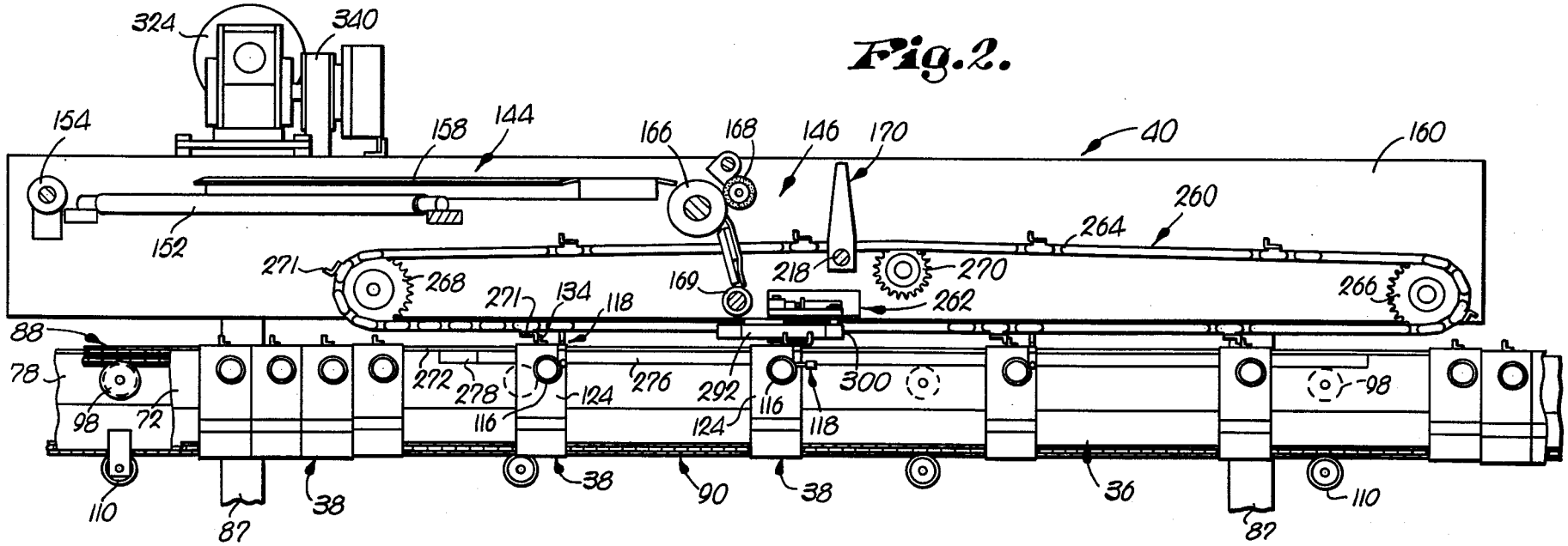
FIG. 2 is an essentially schematic side view illustrating the preferred handling and draping station associated with the invention, with certain parts being broken away for clarity.
Figure 5:
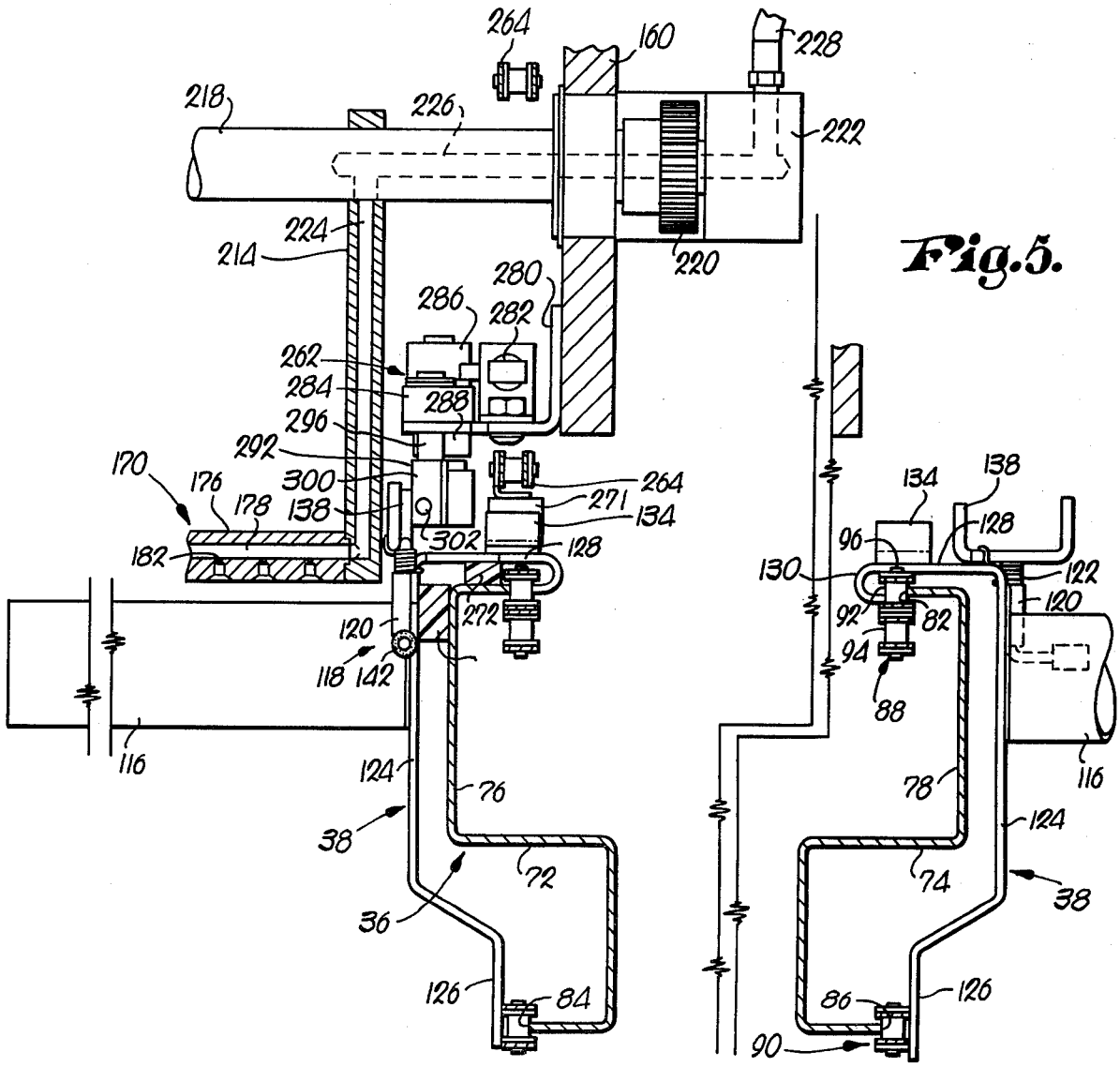
FIG. 5 is a fragmentary view in partial vertical section illustrating the preferred track structure, along with certain aspects of the web handling and draping station.
Figure 9:
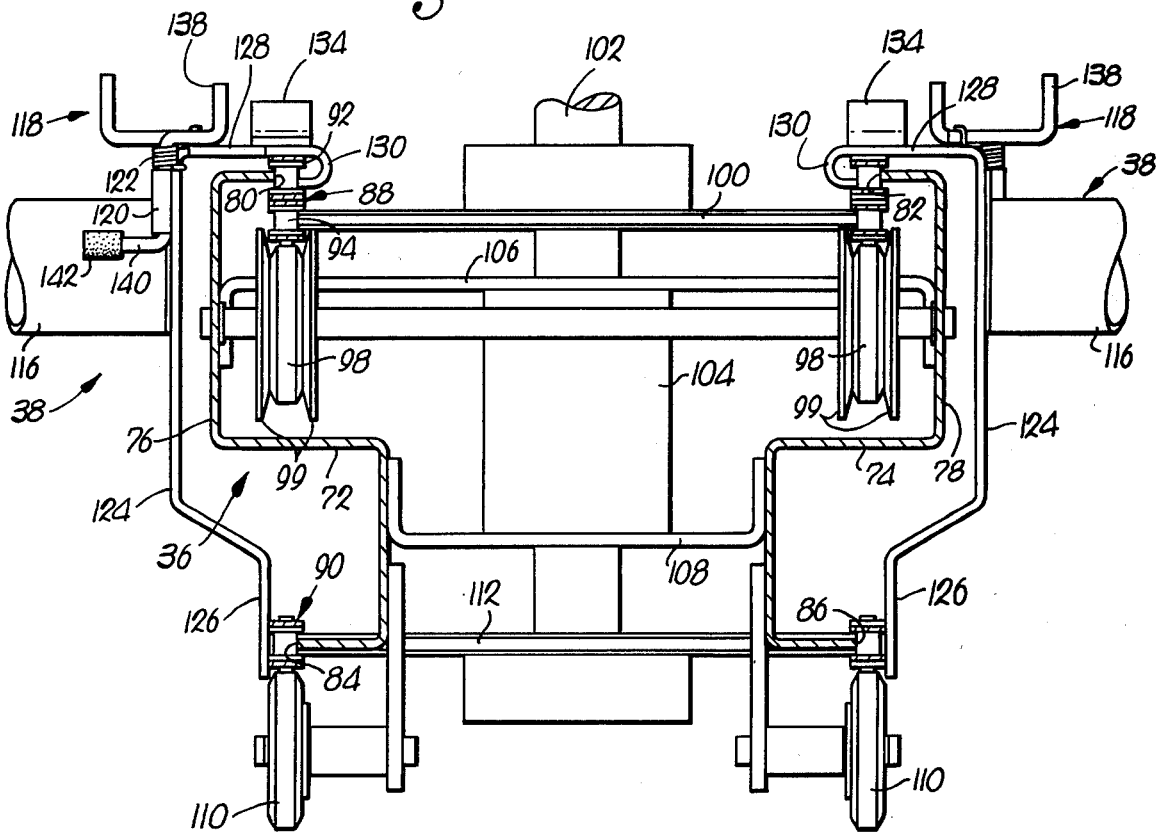
FIG. 9 is a partial sectional view similar to that of FIG. 5 but illustrates the sprocket drive and chain support wheels provided with the track structure.

Turning now to FIGS. 2, 5 and 9, it will be seen that track structure 36 includes a pair of upright, laterally spaced apart, opposed sidewalls 72, 74. These sidewalls include an upper, planar, elongated, vertical portion 76, 78, which terminate at their upper end with inturned lips presenting respective abutment surfaces 80, 82. Likewise, the lowermost ends of the sidewalls 72, 74 are in the form of outturned lips or flanges terminating in lower abutment surfaces 84, 86. The sidewalls 72, 74 are supported in their elevated, operative position by means of a series of spaced apart upright beams 87 (see FIG. 1), along with conventional transverse supports and rigidifying members.

The track structure 36 is further provided with continuous, upper and lower roller chains respectively referred to by the numerals 88, 90. Referring first to the upper chain 88, it will be seen that it comprises a pair of interconnected upper and lower chains 92, 94, with the upright pivot pins of the upper chain 92 presenting upwardly extending, spaced, projections or nibs 96. The double roller chain 88 is shiftable along the track structure and for this purpose is supported on a series of spaced apart rotatable wheels 98 located along the length of each sidewall 72, 74. The wheels 98 each have radial side flanges 99 which serve to captively retain the chain 88 in its proper orientation. A sprocket 100 (see FIG. 9) is positioned adjacent each end of the juxtaposed track sidewalls 72, 74, and is in operative engagement with the lower roller chain portion 94 of double chain 88. The sprocket 100 is in turn journaled on a shaft 102, the latter being supported by a hub 104. Hub 104 is secured between transverse upper and lower support brackets 106, 108 secured to the sidewalls 72, 74. As will be explained hereinafter, the sprocket 100 adjacent the left hand end of track 36 as viewed in FIG. 1 is powered for rotation, in order to shift the continuous roller chain 88 around the track structure 36.

The lower roller chain 90 comprises a single roller chain which is likewise continuous and trained about the track structure. For this purpose, a series of rotatable support wheels 110 are provided beneath the chain 90 in order to prevent undue sagging thereof. In addition, it will be seen that appropriate sprockets 112 are provided adjacent the ends of the sidewalls 72, 74 and beneath the associated upper sprockets 100. The lower sprockets 112 are respectively operatively engaged with the lower roller chain 90 in order to guide and drive the latter. For this purpose, each sprocket 112 is journaled to the adjacent shaft 102 described previously.

Referring again to FIGS. 5 and 9, it will be seen that the upper abutment surfaces 80, 82 of the sidewalls 72, 74 engage the upper roller chain portion 92 of the double chain 88; moreover, the lower abutment surfaces 84, 86 engage the lower roller chain 90. Thus, it will be appreciated that the upper and lower sidewall abutment surfaces provide additional support and guidance for the roller chains 88, 90.

Figure 8:
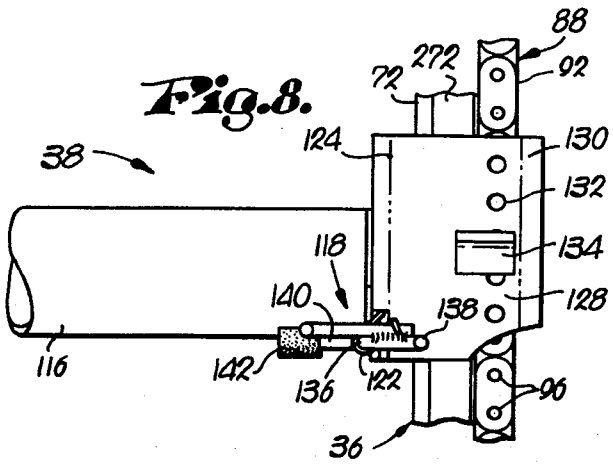
FIG. 8 is a view similar to that of FIG. 6 but illustrates the keeper in its closed, webengaging position.
Figure 7:
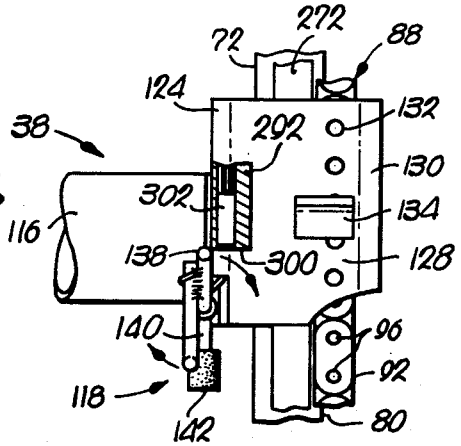
FIG. 7 is a fragmentary top view illustrating a web support with the keeper thereof opened.
Figure 6:
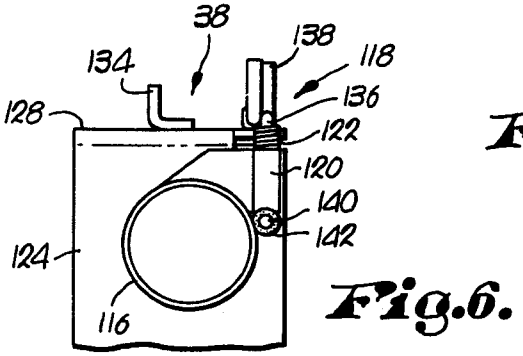
FIG. 6 is a fragmentary side view illustrating the construction of one of the preferred supports.

The web supports 38 (see especially Figs. 6–8) are identical and each include an elongated, tubular web-supporting element 116 (advantageously formed of 1½-inch PVC pipe 18½-inches long), a web keeper referred to by the numeral 118, a mount 120 for the keeper 118, and a torsion spring 122 serving to bias the keeper 118 toward the element 116. In addition, each web support 38 includes a hanger 124 secured to one end of the element 116 for suspending the entire web support in a cantilever fashion on track 36.

The hanger 124 is in the form of an elongated plate which generally conforms to the configuration of the sidewalls 72, 74. To this end, each hanger 124 includes a lowermost planar engagement portion 126 (see FIG. 9) which rides against the outer surface of the lower roller chain 90 remote from the associated sidewall, as well as a top plate 128 having arcuate inboard terminal lip 130 which is adapted to abuttably engage the inner surface of the upper portion 92 of double roller chain 88. A radius is removed from one corner of the hanger on the top to allow the hangers to negotiate the corners of track structure 36 at the region of the sprockets 100 without interference. In addition, the plate 128 is provided with a series of apertures 132 for receiving respective nibs 96, and an L-shaped, upwardly extending lug 134, which are important for purposes to be described.

The keeper 118 includes an elongated, upright intermediate portion 136, an upper, generally U-shaped actuator portion 138 and a lower, outwardly extending leg 140 provided with a tubular pad 142. As illustrated, the mount 120 is integral with the hanger 124 and rotatably receives the intermediate portion 136 of keeper 118. Thus, the keeper 118 is pivotal about an upright axis generally transverse to the longitudinal axis of the element 116. Moreover, the spring 122 is disposed about intermediate portion 136, with the terminal legs of the spring being arranged so as to bias the keeper 118 to the FIG. 6 position thereof, i.e., with the pad 142 adjacent the element 116. It will also be observed that by virtue of the mounting arrangement for the keeper 118, the latter is also selectively movable to an open position wherein the pad 142 is spaced from the associated element 116 (see FIG. 7).

The web keepers 118 are designed to perform three main functions, namely:

(1) to grip the web and pinch the same against the associated element 116 when a web loop has formed on one side of the element (such operation is described in detail hereinafter), but is just beginning to form on the other side. Naturally, gravity pulls harder on the fully formed side of the loop, and the keeper, when in pinching engagement with the web, insures that the heavy loop on the one side of the bar does not destroy the overall web placement and registration.

(2) The keepers also insure that wind currents or jostling of the web as it traverses the track structure 36 do not destroy web register.

(3) The keepers are also important during web removal, in that they can be opened just long enough to allow the top web to be removed, whereupon the keeper is closed to maintain register between the underlying webs.

Again referring to FIGS. 1 and 2, it will be observed that a plurality of web supports 38 are mounted in side-by-side relationship on the continuous track structure 36 defined by the sidewalls 72, 74, the sprockets 100, 112, double roller chain 88 and lower roller chain 90; moreover, the supports 38 are movable in either a clockwise or counterclockwise direction with the chains 88, 90 along the entire length of the track during operation of the unit 30 as will be explained.

Web handling and draping station 40 broadly includes a turnbar assembly 144 (see Figs. 1, 2 and 21), a web draping device 146, and web support control apparatus 148.

In more detail, the turnbar assembly 144 is essentially conventional, and is designed for turning the web 60 from the orientation depicted in phantom in FIG. 1, at a 90 degree angle until the web is fed along the length of the track 36 and transverse to the respective web supports 38. Specifically, the assembly 144 includes an initial bar 150 in spanning, supporting relationship to the incoming web 60, an oblique turnbar 152, and a final roller 154, for supporting and delivering the turned web. A triangular support plate 158 is positioned between and slightly above bar 152, to provide further web support. The web 60 is trained through assembly 144 as depicted in FIG. 21, and it will be observed that the web is properly turned and oriented without the images 62 contacting any bar or other surface.

The draping device (see FIG. 1) 146 includes a housing 160 located generally between and above the sidewalls 72, 74, and a console guard located adjacent the outer end of the web supports 38 traversing the length of sidewall 72. A drive line is housed within upstanding cover 164 which interconnects the drive for press 32 and that associated with the overall station 40.

Figure 4:
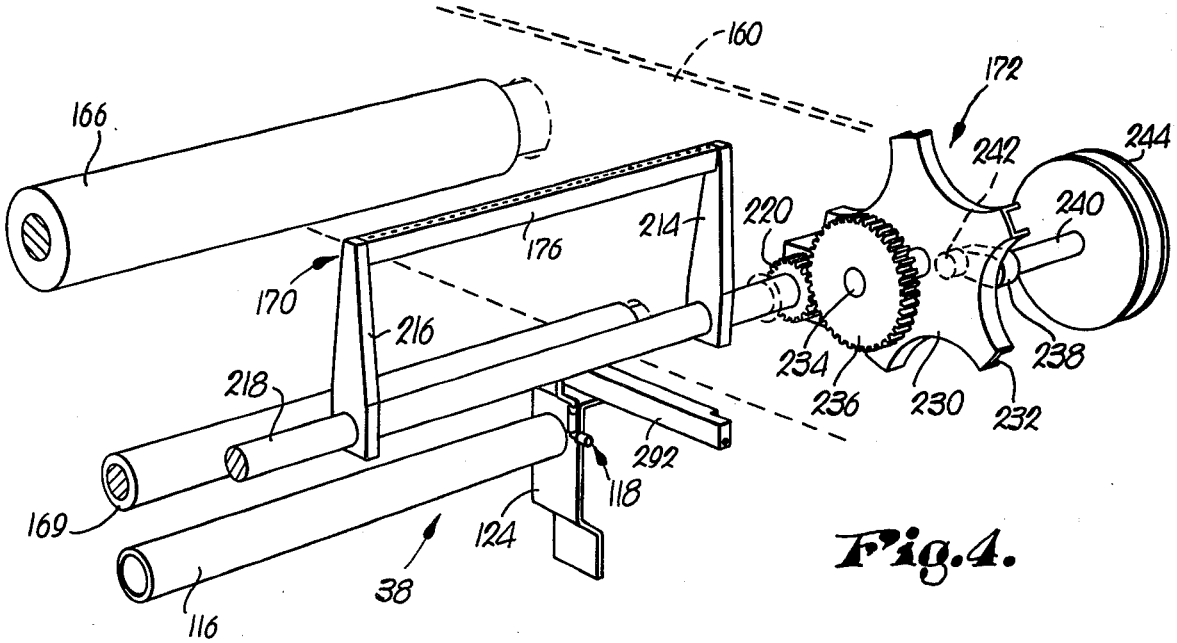
FIG. 4 is an essentially schematic view perspectively illustrating the preferred web handling and draping structure, and the geneva gear mechanism drive therefor.
Figure 23:
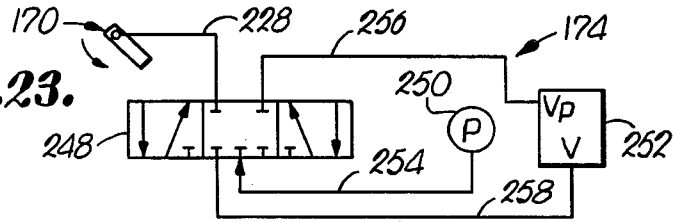
FIGS. 23–25 are respective schematic representations illustrating the vacuum/pressure operational sequence of the air bar during rotation thereof.
Figure 24:
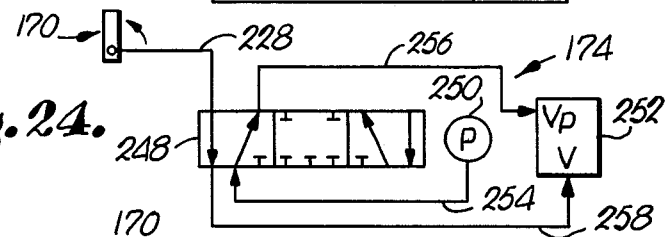
Figure 25:
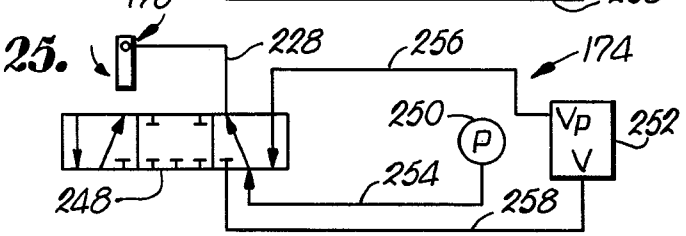

Referring specifically to FIGS. 2, 4, and 5, it will be seen that device 146 includes a drive roller 166, a pair of opposed web edge-engaging drive wheels 168, a lower web support roller 169, as well as an elongated, shiftable air pickup bar 170. Drive for bar 170 is provided by means of an internal geneva gear mechanism 172, whereas air and vacuum supply to the bar 170 is effected by means of control assembly 174 (FIGS. 23–25).

Figures 10, 11, 12, 13, 14, 15, 16:
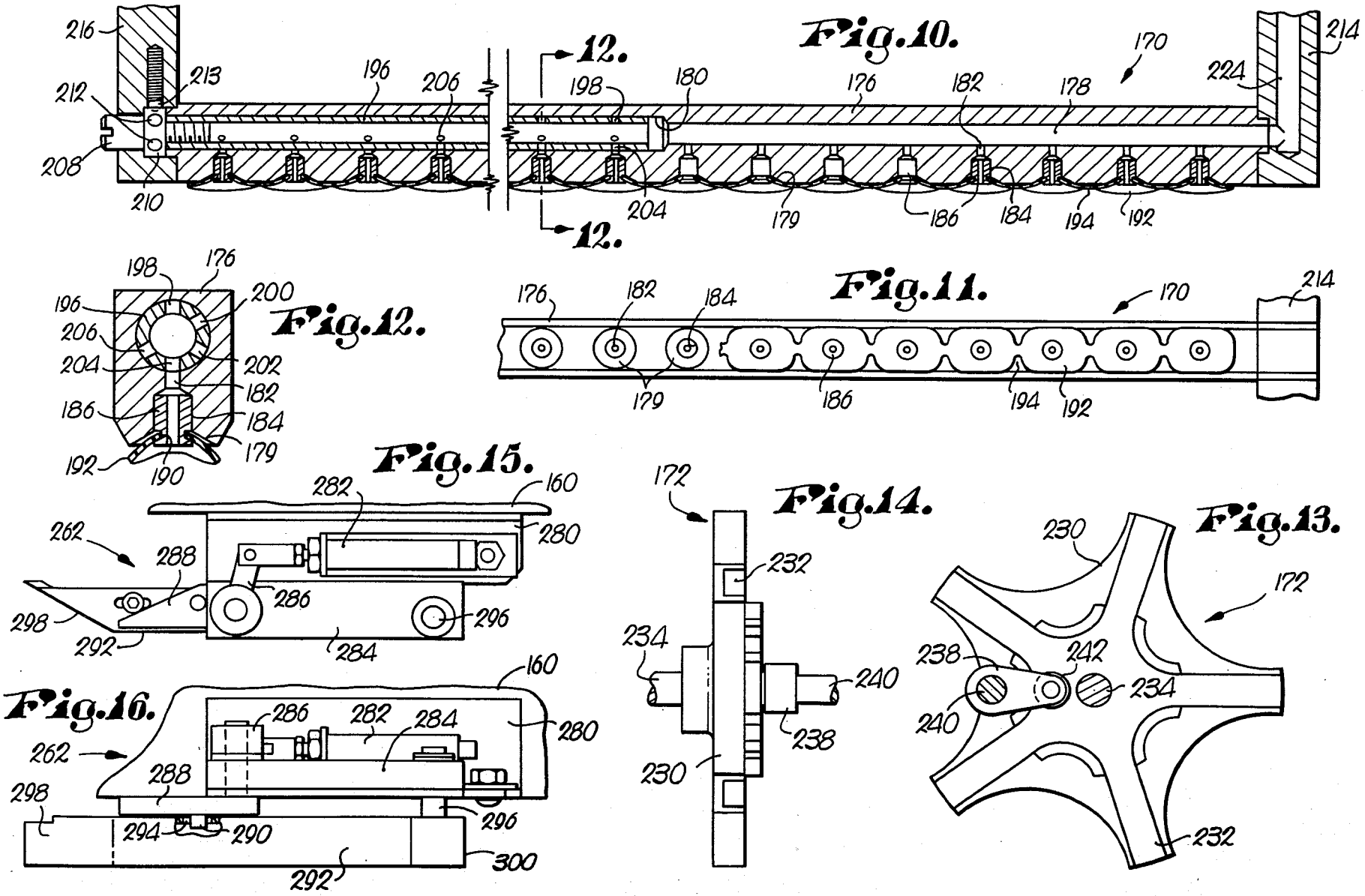
FIG. 10 is a fragmentary view in vertical section illustrating the construction of the preferred shiftable air bar associated with the web handling and draping station.
FIG. 11 is a bottom view of the air bar illustrated in FIG. 10, with parts broken away for clarity.
FIG. 12 is a vertical sectional view taken along line 12—12 of FIG. 10.
FIG. 13 is an elevational view illustrating the geneva gear mechansim associated with the web handling and draping station.
FIG. 14 is a side view of the geneva structure depicted in FIG. 13.
FIG. 15 is a plan view illustrating the construction of the actuating mechanism for the web keepers as the corresponding web supports pass through the web handling and draping station.
FIG. 16 is a side view of the structure illustrated in FIG. 15.
Figure 18:
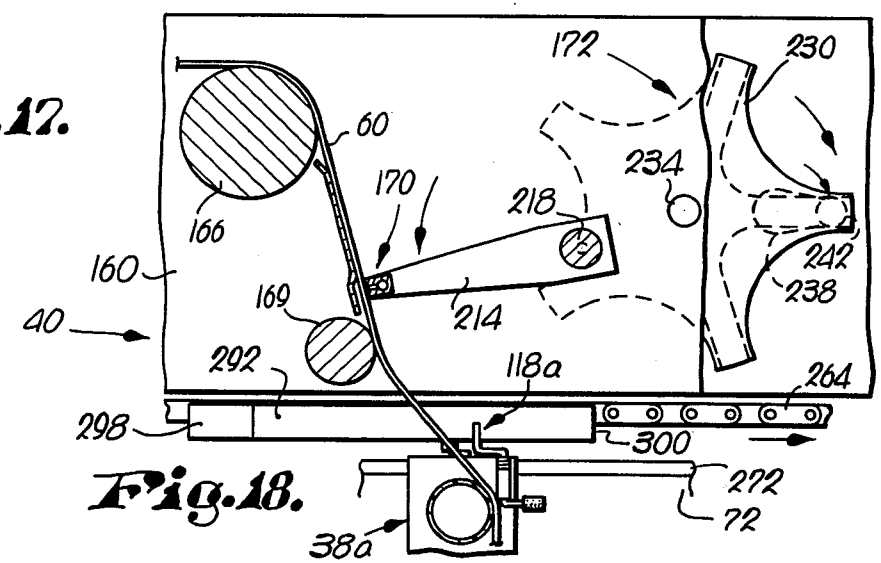
FIGS. 17–20 are respective, generally schematic views in partial vertical section and with parts broken away for clarity illustrating the web feeding and draping sequence, and with the orientation of the geneva gear drive mechanism being depicted in phantom.

Air pickup bar 170 (FIGS. 10–12) is in the form of an elongated bar-like element 176 having an elongated, continuous bore 178 therethrough, and a series of concavities 179 along the length thereof. As best seen in FIG. 10, the bore 178 is enlarged as at 180 to present a greater diameter for the outermost portion of the bar, i.e., that portion of the bar spaced from the housing 160.

Bar 170 is further provided with a series of ports 182 along the length thereof which are respectively in communication with the bore 178 and corresponding concavities 179. Each port 182 is enlarged as at 184 in order to receive an annular outlet plug 186. Each plug 186 (see FIG. 12) extends outwardly from the corresponding concave surface 179 of bar 176, and is circumferentially notched as at 190; in addition, it will be seen that the central bore of the plug 186 serves to communicate the associated bore 182 with the atmosphere.

An improved, resilient, web-engaging suction surface is provided by means of an elongated, continuous, resilient pad 192. The pad 192 extends the full length of bar 176 and is positioned in closely conforming relationship within the concavities 179. Moreover, the pad is apertured at locations corresponding to the respective plugs 186, and the pad is captively retained in position by insertion thereof into the respective plug notches 190 (see FIG. 12). Inasmuch as the notches 190 are below the face of bar 176, a cuplike recess of elongated, somewhat oval shape is formed in the pad 192 at each concavity 179. It will further be seen (FIG. 11) that the pad 192 is relieved as at 194 between the pad openings. In this fashion, the pad presents a series of suction areas or zones along the length thereof corresponding to the locations of the individual outlet plugs 186. It has been found that this construction not only lessens manufacturing costs, but also gives enhanced operational advantages.

The pad 192 permits use of a smaller width of suction area than is required with conventional larger round suction cups, since the elongated oval shape of the individual suction areas provides a more efficient use of available suction area. This is particularly important when using certain types of paper stock and inks which cause the printed images to remain wet for relatively long periods of time. This makes it necessary to pick up the web only at the relatively narrow, unprinted areas known as the plate and blanket gaps, and therefore use of relatively wide suction cups can present serious problems of ink smearing. Also, the relatively large number of narrow suction areas has been found to be effective in eliminating other adverse effects including web wrinkling, which causes loss of vacuum. Finally, the fact that the pad 192 is preferably a strip of material in one continuous piece prevents the individual suction areas from rotating out of position and also simplifies assembly since fewer pieces have to be handled. It should further be recognized that a suction pad of this type is adaptable to many uses other than those described herein.

The bar 170 is also provided with means for varying the effective length thereof. That is to say, the bar is equipped with structure allowing the operator to vary the number of ports 182 exposed to positive pressure and/or vacuum conditions. In this way, the effective length of the bar can be varied, so as to accommodate webs of differing widths. Specifically, the bar is provided with an elongated, axially rotatable tube 196 positioned within the enlargement 180 of bore 178. The tube 196 is provided with respective juxtaposed sets of aligned apertures 198, 200, 202, 204 and 206. Each set of apertures includes a designated number of apertures which are each axially aligned with a corresponding port 182; and the number of apertures in each set is different. Selective rotation of the tube 196 to position the sets of apertures in alignment with corresponding ports 182 is achieved by means of an indexing plug 208 secured to the tube 196 and extending outwardly from the left hand end of bar 170 as viewed in FIG. 10. The plug 208 includes an enlarged collar 210 having detents 212 therein corresponding to the respective aperture sets 198–206. A spring biased ball 213 is provided for receipt by the detents 212. As those skilled in the art will readily understand, the plug 208 can be axially rotated until a desired set of apertures is aligned with the corresponding ports 182, with the accuracy of positioning of the aperture sets being assured by means of the described ball and detent mechanism.

The air pickup bar 170 is mounted on respective elongated arms 214, 216 which are in turn secured to an elongated transverse drive shaft 218. The inboard end of shaft 218 extends into housing 160 and is provided with a gear 220 and a rotary union 222, the latter mounting shaft 218 for axial rotation. Further, as best seen in FIGS. 5 and 10, the arm 214 is provided with a central elongated passageway 224 therethrough, whereas shaft 218 and union 222 are bored as at 226. The bore 226 is in communication with passageway 224, and the latter is in turn in communication with bore 178. Finally, the bore 226 is in communication with an external air line 228.

The internal geneva gear mechanism 172 serves to intermittently rotate the air pickup bar 170 through the medium of shaft 218 and arms 214, 216. The mechanism provides appropriate dwell times at the six and twelve o'clock positions of the air pickup bar. The geneva mechanism 172 (see FIGS. 4, 13 and 14) includes a geneva wheel 230 provided with five, spaced apart radial slots 232 as well as an output shaft 234 and gear 236 serving to couple the wheel 230 with gear 220 affixed to shaft 218. The geneva wheel 230 is driven through an input crank 238 coupled to an input shaft 240. The crank 238 includes a follower 242 which rides within the slots 232, as those skilled in the art will readily appreciate. Finally, the input shaft 240 is connected to a belt driven wheel 244 which is ultimately powered through a three-way drive system to be described hereinafter.

The criticality of the geneva gear mechanism in the operation of unit 30 can be appreciated when the difficulty is considered in reaching out and picking up a fast moving web at a particular point thereon, and transferring this to a moving support. If, for example, the web is moving at 500 feet per minute, and the pickup is only one-tenth of a second late, the target would be missed by nearly an inch and registration of the web destroyed. While web pickup could conceivably be accomplished by using a device that rotates at web speed and repeats at target intervals, this does not solve the problem of subsequent web deposition onto a support. The answer therefore is to pick up the web at web speed and then bring it to a stop in order to transfer it without misregistration. For the above purpose the geneva mechanism is ideal, in that it converts uniform rotation into intermittent rotations separated by periods of dwell. Further, since it is a linkage, the geneva output is strictly mechanically timed to its input.

The geneva mechanism 172 is therefore designed to intermittently rotate the bar 170 which makes contact with the web at web speed. Specifically, in the depicted unit, the web 60 is fed to the station 40 by rolls 166, 168, and appropriate gearing between the geneva and the feed rolls causes the bar 170 to make contact with the web every three impression lengths and between impressions. The web follows a nearly vertical path downwardly, and the bar traverses a circular path tangential to the web path; therefore, the bar 170 is nearly horizontal when it contacts the web.

The geneva mechanism 172 is of the internal type, which assures that the indexing period always exceeds the dwell period. The relatively long indexing period provides lower accelerations and a maximum velocity that is maintained nearly constant for a relatively large portion of travel. In order to reduce both acceleration and inertia, a five-slot geneva was selected, and one stage speed up gearing (i.e., gears 220, 236) was employed between the geneva wheel 230 and pickup bar shaft 218 to give a gear ratio of 5:2. Thus, each cycle or slot of the wheel 230 (72°) causes 180° of rotation of the bar 170. Moreover, (see FIGS. 17–20), the bar 170 dwells at the 12 o'clock position, indexes reaching a peak velocity through the 9 o'clock position, dwells again at the 6 o'clock position, and finally indexes through the 3 o'clock position completing one full revolution. The velocity of the operational or pickup face of the bar 170 is matched to web speed by the appropriate length radius or support arms 214, 216.

Positive pressure air or vacuum is intermittently and selectively applied through external line 228 (see FIG. 5) and thence through bore 226, passageway 224 and bore 178 to the respective ports 182, during the operation of the web feeding and draping device 146. Control of the air/vacuum sequence is provided through structure illustrated schematically in FIGS. 23–25. Specifically, air control assembly 174 includes a four-way, three-position, solenoid controlled valve 248, a positive pressure air pump 250, and a vacuum source 252. The assembly further includes positive pressure air input line 254 from pump 252 to valve 248, a positive pressure air line 256 from valve 248 to vacuum source 252, a vacuum line 258 from source 252 to valve 248, and the above described external air line 228 leading to the air pickup bar structure previously detailed.

The FIG. 23 position of assembly 174 is neutral, and neither air nor vacuum is delivered to the bar 170; in FIG. 24, the assembly 174 is positioned to establish vacuum conditions within bar 170, i.e., line 258 and source 252 are communicated through valve 248 with the line 228. Finally, in FIG. 25, positive pressure air is directed to the bar 170, i.e., line 254 and pump 250 are in communication through valve 248 with line 228.

The respective positions of valve 248 thus control whether neutral, positive pressure air or vacuum conditions are maintained within bar 170. Movement of the valve 248 between its operating positions is effected through a conventional solenoid operated through sensors situated within station 40, which sense the position of supports 38 passing through station 40, and the closing operation of the keepers 118.

The web support control apparatus 148 is designed to pick up, accelerate, and accurately control the position and speed of respective web supports 38 as the latter pass through the web handling and draping station 40.

As can be appreciated, it is vitally important that the web supports be properly positioned during the draping sequence, else the webs will be improperly draped and downstream processing adversely affected. Further, the difficulty in obtaining precise placement of the web onto moving supports is increased when the web is moving at relatively high speeds of 500 feet/minute or more, as explained previously.

In order to accomplish the above ends, the apparatus 148 includes a motive assembly 260 for moving and separating the elements 38 during passage thereof through the station 40, and actuation structure 262 for opening the web keepers 118 on the moving supports in order to permit proper draping of web onto the underlying elements 116.

Referring specifically to FIGS. 2 and 5, it will be seen that the motive assembly 260 includes a continuous roller chain 264 which is located adjacent housing 160 and is supported on spaced sprockets 266, 268, with sprocket 268 being driven. An idler sprocket 270 is in operative, supporting engagement with the chain 264 between the sprockets 266, 268. The chain 264 runs faster than the chains 88, 90 (in practice, 5.185 times faster) and carries a plurality of spaced apart (e.g., 14 inches), outwardly extending L-shaped lugs 271 which are adapted to engage the upstanding lugs 134 on the individual hanger top plates 128.

The individual web supports 38 are operatively coupled to the roller chain 88 during the majority of their travel around the track structure 36. That is to say, the apertures 132 provided in each top plate 128 receive the upstanding pivot pins 96 of the roller chain, so that the respective web supports 38 are positively driven with the chain 88. However, when station 40 is reached, it is necessary to separate the supports 38 from the chain 88, which in turn necessitates that the driving connection between the chain and the supports be interrupted. For this purpose, an elongated, stationary, nylon separator bar 272 is positioned along the length of station 40 on the inturned uppermost flange or lip forming a part of sidewall 72. The opposed ends of the bar 272 are beveled so as to facilitate a riding up and down of the individual web supports 38 onto and off of the upper surface of the bar under the influence of moving chain 264 and a drive lug 271. In order to further stabilize the web supports during travel thereof along bar 272, a secondary stabilizer bar 274 is provided. The bar 274 is affixed to the upper sidewall portion 76 of sidewall 72 and is beveled as at 278 at its input end. As best viewed in FIG. 2, the bar 274 is of lesser length than bar 272, but is positioned in the region within station 40 where draping occurs.

The actuation structure 262 (see FIGS. 2, 15 and 16) includes a mounting plate 280 secured to housing 160 and which supports a selectively actuatable pneumatic piston and cylinder unit 282 as well as a block 284. A rotatable crank 286 is pivotally secured to block 284 and includes an arm pivotally coupled to the piston rod of unit 282; the crank further includes a lower shiftable leg 288 which is rotatable with the crank proper, and includes a depending pin 290 (see FIG. 16).

The structure 262 also includes an elongated actuator bar 292 beneath plate 280 which is slotted as at 294 to receive pin 290. The bar 292 is supported for pivotal movement thereof about an upright axis by means of shaft 296 coupled to the bar and secured to block 284. Referring particularly to FIGS. 15–16, it will be seen that the left hand input end of bar 292 is beveled as at 298. The opposite or output end of the bar is squared as at 300, and the butt end of the bar is provided with an optical sensor 302 (see FIGS. 5 and 7). The sensor 302 is operable to sense the closing of the respective keepers 118 after clearing the squared end of the bar 292, as will be explained in detail hereinafter.

The bar 292 is thus mounted for pivoting movement thereof about the upright axis defined by shaft 296. Such pivoting is effected by operation of the unit 282, i.e., extension of the piston rod thereof serves to pivot the bar outwardly relative to the housing 160, whereas retraction of the piston rod has the opposite effect.

In the retracted position, the bar 292 is positioned for engaging the individual actuator portions 138 of the keepers 118, so as to permit draping of the web 60 onto the underlying web support elements 116. When the bar 292 is in its outermost position, however, the actuator portions engagement.

The overall unit 30 is provided with a web takeoff station or assembly **40*a* (see FIGS. 1 and 3) essentially identical with the station 40. The takeoff station 40*a* is positioned adjacent the left hand end of unit 30 proximal to the processor 42, and includes a web takeoff device and a web support control apparatus having a driven, lugcarrying chain 264*a*. During operation of station 40*a*, the individual keepers 118 of the supports 38 are opened, the draped web or webs are removed from the elements 116, and the keepers 118 are then allowed to close. For this purpose the station 40*a* is equipped with a motive assembly and keeper actuation structure such as that described in conjunction with station 40. In addition, the station 40*a* includes conventional web support bars and the like such as bars 306, 308 and inclined "waterfall" web support 310 leading to processor 42**.

Figure 3:
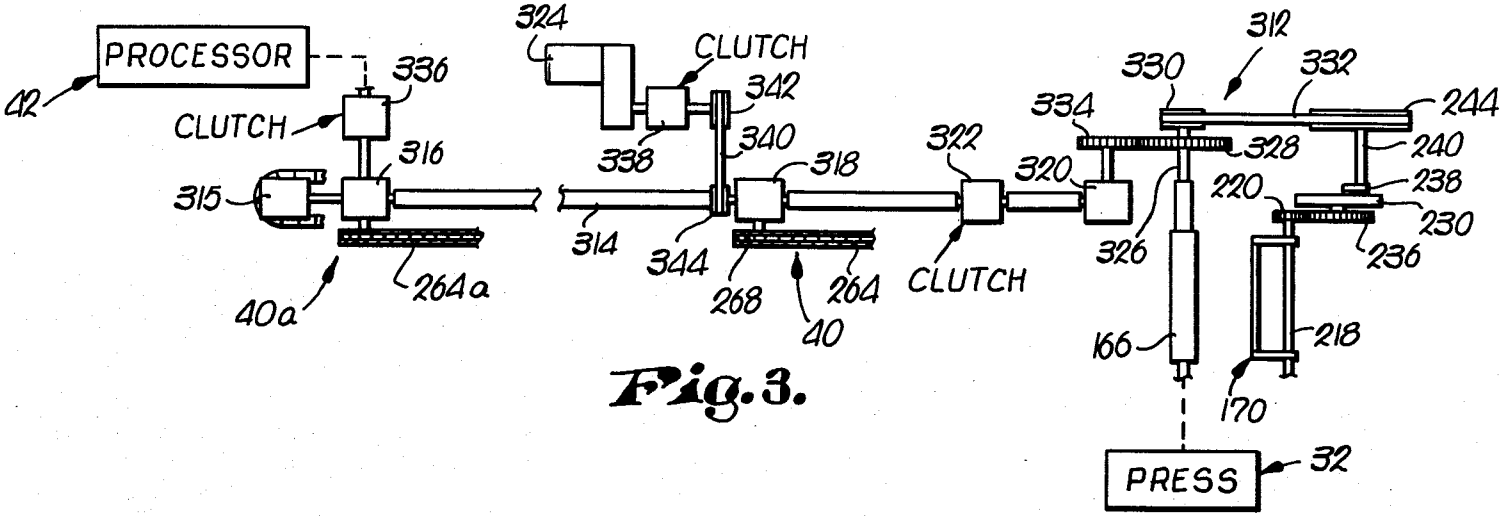
FIG. 3 is a schematic representation of the preferred three-way drive system forming a part of the overall invention.

The primary drive for the unit 30 is provided by means of drive assembly 312 (see FIG. 3). The assembly 312 is operable to shift the supports 38 in either a clockwise or counterclockwise direction around track structure 36, and moreover provides properly timed drive for web feeding and draping station 40, and takeoff station **40*a*. Specifically, the assembly 312 includes an elongated main drive line 314 extending along the length of track 36 and having interposed therein four gear boxes 315, 316, 318 and 320, and a selectively operable single position clutch 322 between the boxes 318, 320**.

The drive line 314 can be operated from three separate sources, namely, the press 32, end processor 42, or motor 324 situated atop housing 160. For purposes of press drive, the main drive line for the press 32 is operatively coupled to drive-transmitting structure including a shaft 326 having a gear 328 secured thereto. The shaft 326 additionally has a wheel 330 journaled thereto, and a belt 332 extends between wheel 330 and wheel 244 in order to provide drive to the geneva gear mechanism described previously. An additional gear 334 is engaged with the gear 328, and is in turn operatively coupled with gear box 320 to provide input to the latter for operation of the main drive line 314.

In order to permit timed driving of unit 30 through processor 42, the drive associated with the latter is operatively coupled to gear box 316 through a selectively operable single position clutch 336. On the other hand, auxiliary drive from the motor 324 includes a selectively operable clutch 338, and a belt 340 trained around wheels 342, 344 respectively coupled to the output shaft of clutch 338 and drive line 314.

As can be appreciated from the foregoing, when the drive for press 32 is employed to drive the overall unit 30, clutch 322 is engaged whereas clutches 336, 338 are disengaged. This results in operation of the entire apparatus, including the stations 40 and 40*a*, and shifting of the chains 88, 90 through the medium of gear box 315. This further ensures that the chains 88, 90 are driven in time with the press 32, enabling printing and web feeding; moreover, the single-position nature of clutch 322 permits a driving connection only once per cycle of the loop forming air pickup bar 170 (a single cycle being one web loop). When operation of the overall unit through the processor drive is desired, clutch 336 is engaged, whereas clutches 338 and 322 are disengaged. In this event, the chains 88, 90 will operate in time relationship with the stations 40, 40*a*; in the event that, during this mode of operation, no web is being draped onto the supports at station 40, clutch 322 can be disengaged and this has the effect of stopping operation of the web feeding apparatus. Again, strict timing of the chains 88, 90 and 264, 264*a* and thereby web registration is maintained by the single position clutch 336; the processor 42 can drivingly engage the conveyor 34 only at a selected point during loop removal.

Finally, when motor 324 (which can be a single speed, or, preferably, a variable speed motor) is employed to drive the unit 30 in the auxiliary mode, clutch 338 is engaged and clutches 336 and 322 are disengaged.

In the embodiment illustrated in FIG. 1, end processor 42 is in the form of a gluing unit 346 and a sheeter 348. The end processor 42 is adapted to receive one or more webs from the conveyor 34, and to perform additional processing steps thereon. Those skilled in the art will also appreciate that other end processors such as collators and the like could also be used where the situation demands it.

OPERATION

In the ensuing discussion, it is assumed that press 32 is continuously operating, and is feeding printed web 60 to the conveyor system 34. Under this operational mode, drive for the conveyor 34 is provided by the press, with clutch 322 engaged and clutches 336, 338 disengaged. Thus, the chains 88, 90 are continuously rotated in order to shift the engaged web supports 38 along the track structure 36; and a web feeding and draping station 40 is in operation, involving rotation of chain 264 and shifting of air bar 170.

When the press 32 and conveyor 34 are thus operating, the station 40 operates to successively place respective web sections onto the web supports 38 driven therepast. This operation is best understood with reference to FIGS. 2 and 7–20.

Specifically, as each respective web support approaches the station 40, it first encounters the beveled leading edge of separator bar 272, and begins to ride up on the latter. This serves to separate the support 38 from the underlying drive chain 88, i.e., the driving connection between the pivot pins 96 and apertures 132 is broken. After the respective support 38 has ridden up onto the bar 272, the upstanding lug 134 carried by the support is engaged by a corresponding drive lug 271 affixed to moving chain 264. Inasmuch as the chain 264 is timed to move at a faster speed than that of underlying chains 88, 90, it will be appreciated that the web supports are separated from one another along the length of station 40 (see FIG. 2). In order to further stabilize the supports 38 and ensure smooth travel thereof along the length of the station 40, the supports are designed to engage stabilizer bar 276 along the majority of the length of the station.

When the web support 38 reaches a point where draping of web thereover is to commence, it encounters actuator bar 292, which has been shifted into its operational configuration illustrated in FIG. 2. Specifically, the U-shaped actuator portion 138 of the keeper 118 engages the beveled section 298 of bar 292, and this serves to pivot the portion 138, and thereby the keeper 118, about an upright axis (see FIG. 7), until the pad 142 is shifted away from the associated web support element 116. This permits draping of web over the element 116 as will be described in detail hereinafter. When the web support reaches the end of actuator bar 292, at which time draping of web thereover has been completed, the actuator portion 138 of the keeper 118 passes squared end 300 of bar 292; at this point, the keeper 118 is quickly returned to its normal position adjacent element 116 under the influence of torsion spring 122. In this condition, the pad 142 firmly engages and pinches a web against the element 116 in order to maintain proper registration. Such return shifting of the keeper 118 is sensed by sensor 302 for purposes which will be made clear.

After passing actuator bar 292, the draping of a web section over the element 116 is completed, and the now draped web support 38 traverses the remaining length of station 40 under the influence of the engaged drive lug 271. At the end of the station 40, the support 38 passes the end of stabilizer bar 274, and moreover passes down the beveled output edge of separator bar 272. At this point the driving connection with chain 88 is reestablished, in that the apertures 132 provided in top plate 128 mate with and receive respective upstanding pins 96. In this condition, the supports 38 can travel around the remainder of track structure 36 until redraped with another web or fed to end processor 42.

Figure 17:
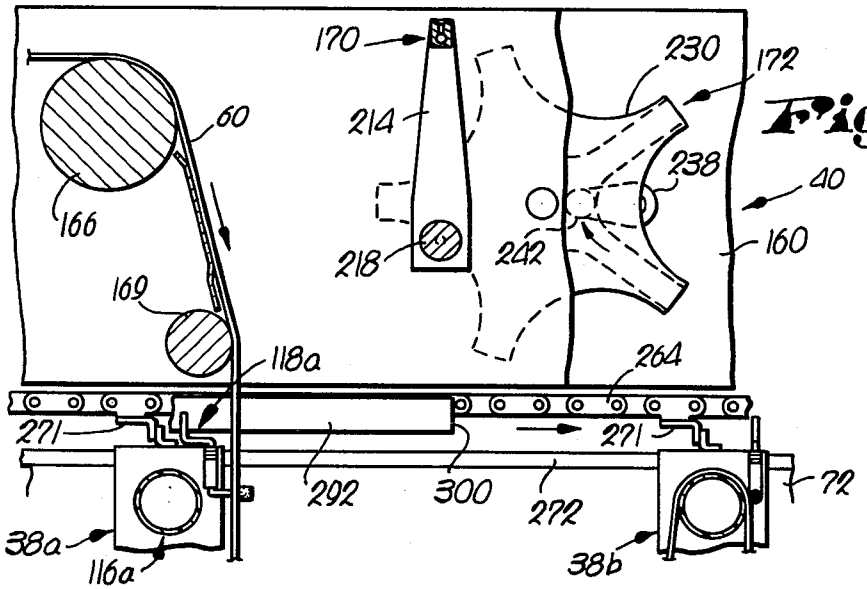
Figure 19:
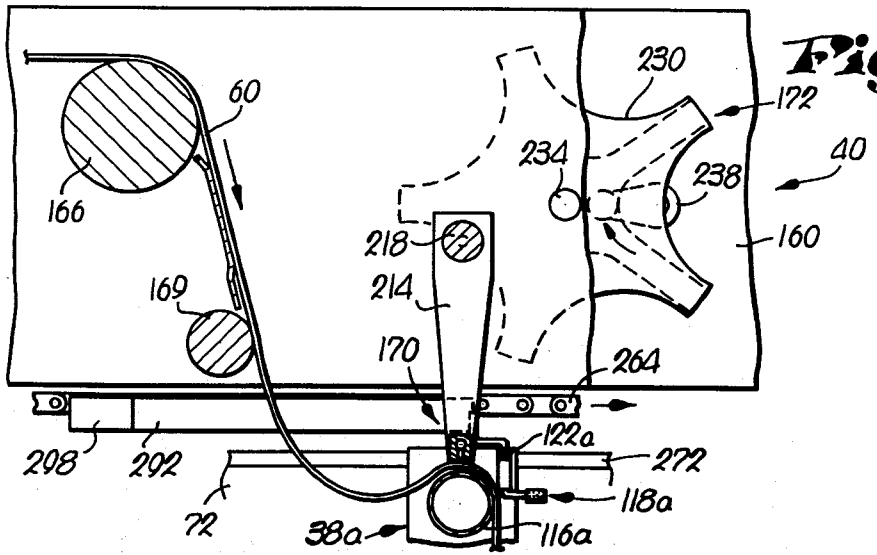

During the above described sequence of separation and acceleration of the web supports 38 within station 40, and particularly during the time when the respective keepers 118 are in their opened position under the influence of actuator bar 292, individual sections of continuous web 60 are draped over the support elements 116. This is accomplished through the medium of driven rollers 166, 168, and rotating air pickup bar 170. As noted above, it is essential that the web 60 be engaged by bar 170 at a precise point on the web between printed images, and that the bar deposit the web in precise, registered relationship to an underlying web support element 116. Attention is particularly directed to FIGS. 17–20 which illustrate the operation of pickup bar 170 in relation to the geneva gear mechanism 172. In FIG. 17, it will be observed that two web supports, 38*a* and 38*b* are illustrated. It will be seen that the web 60 is fed via the rollers 166, 168, to the right of web support 38*a*. During this sequence, the keeper 118*a* associated with the support is in its open position, having engaged the actuator bar 292. At this time the pickup bar 170 is in its 12 o'clock position, and the geneva mechanism 172 is oriented as illustrated.

Web 60 is continuously fed for support over element 116*a* as the support 38*a* traverses station 40 from left to right as viewed in FIGS. 17–20. Also, the bar 170 is rotated under the influence of the geneva mechanism 172 (see FIG. 18) until the bar engages and picks up the web. In particular, the bar 170 is rotated such that the web-engaging face thereof, at the point of contact with web 60, is traveling at essentially the same speed as the web. This assures that there is no significant relative movement between the web and contact face of air pickup bar 170, to facilitate positive engagement and pickup. Also, during this pickup sequence, the assembly 174 is in its FIG. 24 position, i.e., vacuum conditions are created within the ports of the bar 170, such having been established by means of a sensor (not shown) within station 40 operatively coupled with valve 248. The amount of vacuum is variable through valve 252, and can be as much as minus 20 inches of mercury for heavy stock running at high speed.

After the web 60 is thus engaged and picked up, rotation of the bar 170 continues (see FIG. 19) until the bar is situated directly above the element 116*a*. At this point the bar 170 is in a dwell position, and is holding the engaged portion of the web directly over the element 116*a*. Of course, the web is still being fed into the station 40 at this time.

Figure 20:
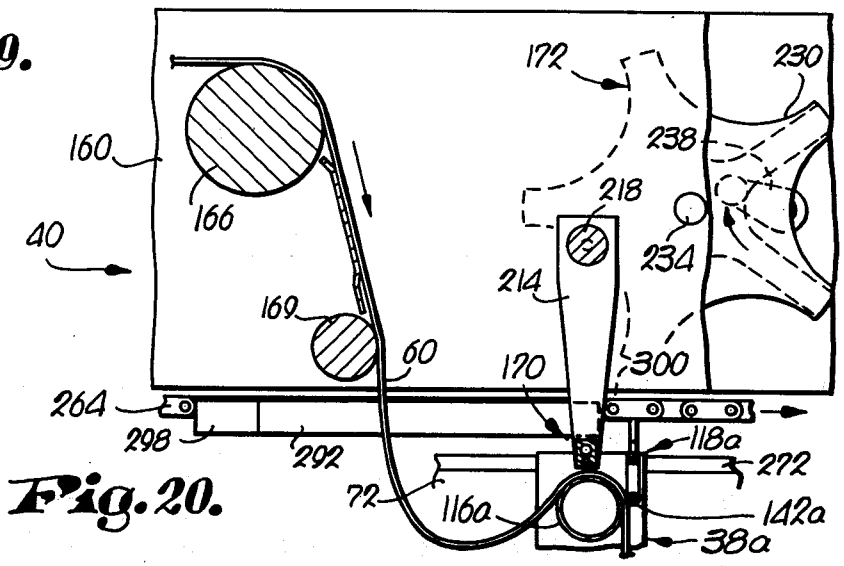

Shortly after the bar 170 is in its 6 o'clock dwell position, the support 38*a* passes the squared end 300 of bar 292 (FIG. 20). This then causes the keeper 118*a* to pivot under the influence of spring 122*a* back to its normal position; this action is very rapid taking on the order of 10 milliseconds. At this time, sensor 302 senses keeper movement and shifts valve 248, so that the vacuum within bar 170 is relieved, the assembly 174 assumes the position of FIG. 25, and a burst of positive pressure air (e.g., 40–60 pounds per square inch for 25 milliseconds) is directed through the air pickup bar ports so as to facilitate dislodgement of the web 60 from the pickup bar. The pinching effect of the pad 142*a* against the web and element 116*a* assures that the web section over element 116*a* remains in a registered condition. Further, this pinching action assures that the drape of web over the element 116*a* can be completed without shifting of the web section relative to the underlying support.

In the preferred form of the invention, the geneva mechanism 172, and the overall control circuitry, are designed such that web pickup by bar 170 occurs only during every other revolution of the bar. This operational sequence was established in order to minimize acceleration and inertia problems within the bar which could occur if the bar were rotated at a speed to engage and pick up the web during every revolution.

Figure 22:
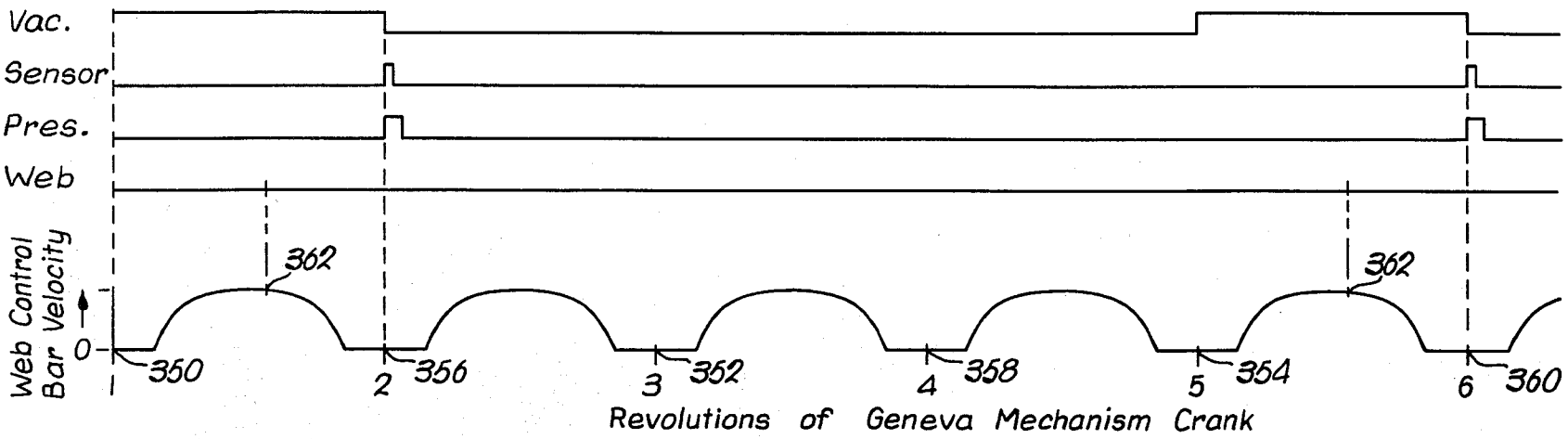
FIG. 22 is a graph illustrating the rotation of the web-engaging air bar versus the revolutions of the geneva mechanism crank, with the operational graphs of the web, positive pressure in the air bar, sensor, and vacuum in the air bar above the main graph to depict the sequence of operation of all of these components.

The relationships described above are graphically depicted in FIG. 22. Thus the lowermost graph in FIG. 22 illustrates the revolutions of the geneva mechanism crank relative to the velocity of air bar 170. Points 350, 352 and 354 represent the 12 o'clock position of the air pickup bar 170 (e.g., FIG. 17), whereas points 356, 358 and 360 represent the 6 o'clock position thereof. It will further be observed that the pickup bar 170 "dwells ", or has zero velocity, at all of the points 350–360, such being accomplished by virtue of the internal geneva gear mechanism 172.

Point 362 located between points 350 and 356 represents the web pickup point wherein web 60 becomes affixed to bar 170. It will be seen that, in the uppermost graph line of FIG. 22, a vacuum is drawn within bar 170 prior to, during and after the pickup point 362.

At point 356, it will be seen that sensor 302 is actuated (by virtue of the pivoting of keeper 118), and this in turn serves to shift the valve 248, so as to terminate the vacuum condition and send a burst or pulse of pressurized air through bar 170 for the purposes described.

Between points 356 and 354, it will be seen that air pickup bar 170 is sequentially rotated and stopped at its 6 and 12 o'clock positions, but that no web pickup or operation of valve 248 or sensor 302 occurs. Web pickup is repeated however between points 354 and 360, as illustrated by pickup point 364.

As respective sections of web 60 are draped over individual supports 38 traversing track structure 36, the web is air dried without the necessity of conventional heating or the like. Moreover, the web is maintained in its proper, registered relationship with the supports 38 by means of the keepers 118 associated therewith.

Figure 26:
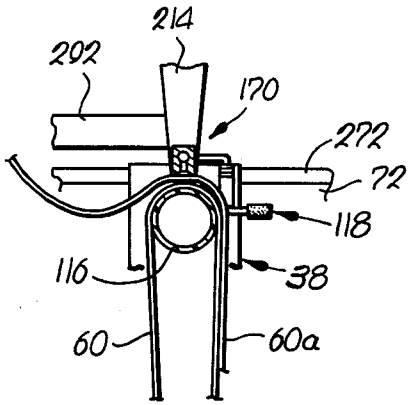
FIG. 26 is a fragmentary view illustrating the placement of a second web atop an initially draped first web on a web support.

In the usual situation where multiple webs are employed (see FIG. 26), the webs are simply placed one atop the other in conforming, draped, registered relationship over the individual web supports 38. This feeding and draping operation is identical with that described above, and thus need not be repeated. Although only two webs 60, 60*a* have been illustrated in FIG. 26, those skilled in the art will understand that a different number of webs can be draped one atop the other and supported by the supports 38.

When the required number of web(s) is thus supported, the web(s) can be fed to end processor 42 for additional downstream processing. In such a situation, it is necessary to maintain the register between the web(s) and processing equipment, and therefore the drive for the overall unit 30 is advantageously provided by processor 42. Referring to FIG. 3, it will be seen that, during end processing, clutch 336 is engaged whereas clutches 338 and 322 are disengaged. Thus, as the draped web(s) approach station 40*a*, the respective support bars 38 are separated and web is continuously removed therefrom and fed to end processor 42 in timed relationship. In this operational mode, chains 264 and 264*a* operate, but actuator bar 292 is in its non-operative position, so that the keepers associated with the web supports traversing station 40 are not opened, and registration is maintained. Of course, disengagement of clutch 322 means that the geneva mechanism and air bar 170 will not operate.

In certain instances it may be desirable to operate the unit 30 using motor 324. In this auxiliary mode, clutch 338 is engaged, whereas clutches 336 and 322 are disengaged. Moreover, the actuator bar 292 associated with station 40, and similar actuating bar structure associated with station 40*a*, are in their non-operative positions. Of course, in this operation there is no timed relationship between movement of the web supports and either the press 32 or end processor 42.

As noted above, the support elements 116 associated with the supports 38 are advantageously 18 inches in length, and are thus able to provide full support for a conventional 17 inch width web. By the same token, the air bar 170 is of substantially the same length, so that an even pickup across the width of the web is assured. In the event that webs of lesser width are being printed and processed however, it will be appreciated that the bar 170 will present excess ports which will be open to the atmosphere and out of contact with the web during the pickup sequence. In order to overcome this problem, the indexing plug 208 associated with bar 170 can be rotated to position internal tube 196 at a point corresponding to the width of the web being processed. That is to say, if an 11 inch web were being processed, the tube 196 would be rotated to close off excess ports in the outboard (i.e., spaced from housing 160) region of the bar.

It will thus be appreciated that the present invention provides an apparatus and method for effective storage-in-process of one or more printed webs, and thereby eliminates many of the troublesome and labor intensive steps heretofore required for production of business forms and the like. Of particular importance is the fact that the present invention provides for precise pickup and placement of successive web sections onto underlying, moving supports, all without loss of registration even at relatively high web speeds.

The present invention is also advantageous inasmuch as waste is reduced. Specifically, as the web is printed and fed onto the conveyor structure, it is in full view for ease of continual monitoring and checking. Thus, if sub-standard material begins to come from the press, the entire system can be temporarily stopped, the poor quality material removed, and processing continued. Alternately, the sub-standard material can readily be removed and replaced at a later time. This is to be contrasted with a conventional situation where it often occurs that sub-standard printing is wound up in a roll or is hidden in a stack and is difficult and time consuming to remove. Additionally, multiple webs can be draped over the supports in a substantially collated and registered condition, and it is a simple matter to observe how much web is required to exactly match the length of a previously deposited web, thus eliminating considerable waste.

We claim:

1. A web handling conveyor system, comprising:

an elongated track;

a plurality of web supports each including an elongated web-supporting element, and a web-engaging keeper, and means mounting said keeper for shifting movement thereof relative to the associated element;

means mounting said supports for movement along said track;

means for moving said web supports along said track;

a web feeding station, comprising— means for draping a section of said web over each respective element as said web supports are moved therepast; and means for shifting the keeper of each respective element away from the associated element during draping of said web section thereover, and for shifting of the keeper into engagement with said web section after at least a portion of the draping thereof is completed, in order to hold the draped web section in place, said keeper shifting means comprising structure for selectively engaging each respective keeper as the web support associated therewith passes said web feeding station, for shifting the respective keeper away from the associated element, and for maintaining the keeper in its shifted away position during at least a portion of the draping of said web section, said means for shifting said keeper into engagement with the web section also comprising means biasing the keeper to a web-engaging position adjacent said associated element.

2. The web handling conveyor system as set forth in claim 1, said mounting means including structure mounting said keeper for pivotal movement thereof.

3. The web handling conveyor system as set forth in claim 2, said structure mounting said keeper for pivotal movement about an axis generally transverse to the longitudinal axis of said element.

4. The web handling conveyor system as set forth in claim 1, said keeper being mounted adjacent one end of said element and including a web-engaging pad.

5. The web handling conveyor system as set forth in claim 1, including a hanger member secured to one end of said element for suspending the web support on said track.

6. The web handling conveyor system as set forth in claim 1, including a bracket for supporting said element, and a lug carried by the bracket for engagement by a separate, powered component.

7. The web handling conveyor system as set forth in claim 1, said biasing means comprising a spring.

8. The web handling conveyor system as set forth in claim 1, said keeper including an elongated intermediate shank portion, an upper, generally U-shaped actuator portion, and a lower, padded, web-engaging portion, said mounting means comprising structure shiftably supporting said intermediate portion, said biasing means comprising a coil spring disposed about said intermediate portion.

9. A conveyor system as set forth in claim 1, said draping means comprising:

an air pickup bar;

means for shifting said bar into engagement with said web section and thence into overlying relationship with the respective web-supporting element; and means for creating a vacuum within said air bar during engagement of said bar and web section and during shifting of the bar into said overlying relationship, and for thereafter relieving said vacuum.

10. A conveyor system as set forth in claim 9, said bar-shifting means comprising a geneva mechanism.

11. A conveyor system as set forth in claim 9, including means for sensing the shifting of said keeper to the web-engaging position thereof, and means operatively coupled with said sensing means for actuating said vacuum-relieving means in response to said shifting of the keeper to said web-engaging position thereof.

12. The web handling conveyor system of claim 1, including means for separating said web supports from one another in said web feeding station.

13. In a conveyor system of the type including an elongated track and a plurality of elongated web-supporting elements mounted on the track and shiftable therealong, improved web-handling apparatus for receiving a continuous web and draping web sections over respective elements, comprising:

an air pickup bar presenting a web-engaging face;

means for shifting said bar face into engagement with a web section, and thence into a position overlying a respective web-supporting element; and means for selectively creating a vacuum within said bar during engagement of the bar and web section and during shifting of the bar into said overlying relationship, and for thereafter relieving said vacuum.

14. A conveyor system as set forth in claim 13, said bar shifting means comprising a geneva mechanism.

15. A conveyor system as set forth in claim 13, said bar-shifting means including mechanism for moving said bar face at a speed substantially equal to the speed of said moving web, during said web-engaging step.

16. A conveyor system as set forth in claim 13, said bar moving means including mechanism for stopping said bar in said overlying position.

17. A conveyor system as set forth in claim 13, said vacuum-relieving means comprising structure for supplying a burst of positive pressure through said air bar.

18. A method of handling a continuous web, comprising the steps of:

continuously feeding said web to a web draping station;

continuously passing a series of elongated web-supporting elements through said draping station;

draping an individual web section over each respective element by successively passing each web section adjacent the respective element, and, during such passing, engaging each web section with a vacuum air bar to affix the section to the bar, moving said bar with the section affixed thereto to a position overlying the respective element, and relieving said vacuum.

19. The method as set forth in claim 18, including the step of passing a burst of positive pressure through said air bar to accomplish said vacuum relieving step.

20. The method as set forth in claim 18, including the step of engaging each of said web sections at a point such that web sections of substantially equal length are generated.

21. The method as set forth in claim 18, including the step of causing said bar to stop and dwell at said overlying position.

22. The method as set forth in claim 18, including the step of locking each of said web sections onto the associated elements.

23. The method as set forth in claim 22, including the step of sensing said locking of said web sections, and, in response thereto, relieving said vacuum.

24. The method as set forth in claim 18, including the steps of:

continuously feeding said web from a web fed printing press with successive images being printed on said web; and timing said draping step to coordinate the draping step with the operation of said printing press, such that each individual web section is engaged by said bar only at a specific desired location on the web section.

25. The method as set forth in claim 24, including the step of causing said bar to engage each respective web section at a region between printed images on the web section.

26. Article pickup structure, comprising:

an elongated bar presenting an operational face, an internal passageway extending along the length thereof, and structure defining a plurality of spaced ports extending along the length of said face, said ports extending between and communicating said face and passageway, said ports being constructed and arranged for operative connection to a vacuum source;

structure in communication with said passageway for permitting selective establishment of vacuum conditions at said ports; and an elongated, resilient, apertured, article-engaging pad secured adjacent said face, with respective pad apertures being in alignment with corresponding ports.

27. The structure of claim 26, said face being configured to present a series of concavities along the length thereof and respectively in communication with corresponding ports, said pad generally conforming said concavities.

28. Article-engaging pickup structure, comprising:

an elongated bar presenting an operational face and having an internal passageway extending along the length thereof, and structure defining a plurality of spaced ports extending between and communicating said face and passageway;

structure in communication with said passageway for permitting selective establishment of vacuum conditions at said ports; and means for selectively closing selected ones of said ports to vary the effective length of said bar, said port closing means including— an elongated tube positioned within said passageway and extending along the length thereof, said tube having respective, juxtaposed sets of spaced apertures along the length thereof, said sets each having a different number of apertures and being in circumferentially spaced relationship to each other, the apertures of each set thereof being axially positioned along the length of the tube at positions in axial alignment with corresponding ones of said ports; and means for selectively axially rotating said tube for respectively positioning each set of said apertures with said ports, whereby the ports in alignment with apertures are open, and the ports out of alignment with apertures are closed.

29. The structure of claim 28, including means for indexing said tube at said respective positions.

30. The structure of claim 28, said face presenting a series of concavities along the length thereof and respectively in communication with corresponding ports, there being an elongated, resilient, apertured, web-engaging pad secured adjacent said face, with respective pad apertures in alignment with corresponding ports and said pad generally conforming with said concavities.

31. Article pickup structure, comprising:

an elongated bar presenting an operational face and structure defining a plurality of spaced ports extending along the length of said face, said ports being constructed and arranged for operative connection to a vacuum source, said face being configured to present a series of concavities along the length thereof and respectively in communication with corresponding ports; and an elongated, resilient, apertured, article-engaging pad secured adjacent said face, with respective pad apertures being in alignment with corresponding ports, and said pad generally conforming with said concavities.

32. The structure of claim 31, said pad being unitary and relieved at regions between said concavities, whereby to provide substantially independent vacuum concavities along the length of the pad while still maintaining the integrity of the unitary elongated pad.

33. A method of handling a continuous web, comprising the steps of:

continuously feeding said web to a web draping station at a web speed;

continuously passing a series of elongated web-supporting elements through said draping station; and draping sections of said web over respective, corresponding web-supporting elements in said draping station, said draping step including the steps of— gripping a portion of each web section as said web is continuously fed at said web speed;

causing said gripped portion to become stationary in a draping position adjacent to and spaced from the corresponding element; and securing said web section to said corresponding element in a draped relationship by pinching the web section between said corresponding element and a web keeper, and releasing said gripped portion.

34. The method of claim 33, including the steps of physically translating the gripped portion of said web section to said draping position, and then stopping said gripped portion.

35. The method of claim 33, said pinching step occuring prior to said releasing step.

36. The method of claim 33, said gripping step comprising the steps of engaging said portion with a vacuum air bar to affix the portion to the bar, said releasing step comprising the step of relieving the vacuum.

* * * * *